US010371379B2

(12) United States Patent
Woodruff et al.

(10) Patent No.: US 10,371,379 B2
(45) Date of Patent: Aug. 6, 2019

(54) SELF-EXTINGUISHING TORCH

(71) Applicant: Lamplight Farms Incorporated, Menomonee Falls, WI (US)

(72) Inventors: Robert Woodruff, Oconomowoc, WI (US); Ron White, North Prairie, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 269 days.

(21) Appl. No.: 15/234,804

(22) Filed: Aug. 11, 2016

(65) Prior Publication Data

US 2018/0045411 A1 Feb. 15, 2018

(51) Int. Cl.
*F23N 5/24* (2006.01)
*F23D 3/32* (2006.01)
*F23D 3/26* (2006.01)

(52) U.S. Cl.
CPC ..... *F23N 5/247* (2013.01); *F23D 3/26* (2013.01); *F23D 3/32* (2013.01)

(58) Field of Classification Search
CPC ..... F21V 37/002; F23N 5/247; F23D 3/26; F23D 3/32
USPC ..... 431/289, 33, 34, 88, 301–309, 315–318
See application file for complete search history.

(56) References Cited

U.S. PATENT DOCUMENTS

2007/0218413 A1* 9/2007 Heng-Wei ..... F23D 3/26 431/320
2012/0122041 A1* 5/2012 Billy ..... F21V 35/00 431/2

FOREIGN PATENT DOCUMENTS

WO WO 2010040155 A2 * 4/2010 ..... F23D 3/26

* cited by examiner

*Primary Examiner* — Avinash A Savani
*Assistant Examiner* — Rabeeul I Zuberi
(74) *Attorney, Agent, or Firm* — David G. Woodral; GableGotwals

(57) ABSTRACT

A self-extinguishing torch top has a wick holder with an upper end and a lower end, affixed to a fuel canister top. An extinguisher surrounds the wick holder and has at least a retracted position wherein a wick protruding from the wick holder is sufficiently exposed to be allowed to burn, and at least an extended position wherein the extinguisher extends beyond the wick so far as to extinguish any flame on the wick. A biasing member urges the sliding tube toward the extended position, and an arrest mechanism retains the sliding tube in the retracted position until an impact occurs, upon which the arrest mechanism releases the sliding tube to allow its extension to the extended position.

14 Claims, 4 Drawing Sheets

SELF-EXTINGUISHING TORCH

FIELD OF THE INVENTION

This disclosure relates to liquid fueled torches in general and, more particularly, to a liquid fuel torch with enhanced safety features.

BACKGROUND OF THE INVENTION

Liquid fueled torches are utilized for a number of purposes such as lighting, decoration, and pest repellence. This disclosure relates to liquid fueled torches with added features.

SUMMARY OF THE INVENTION

The invention of the present disclosure, in one aspect thereof comprises a self-extinguishing torch top having a wick holder with an upper end and a lower end, and affixed to a fuel canister top. The device includes an extinguisher surrounding the wick holder and having at least a retracted position wherein a wick protruding from the wick holder is sufficiently exposed to be allowed to burn, and at least an extended position wherein the extinguisher extends beyond the wick so far as to extinguish any flame on the wick. A biasing member urges the sliding tube toward the extended position, and an arrest mechanism that retains the extinguisher in the retracted position until an impact occurs, upon which the arrest mechanism releases the extinguisher to allow its extension to the extended position.

In some embodiments, the arrest mechanism comprises at least one detent extending inward toward the extinguisher and at least one recess defined in the extinguisher for receiving the detent when the extinguisher is in the retracted position. The arrest mechanism may further comprise a plurality of detents spaced radially about the extinguisher. The arrest mechanism may also comprise a retainer attached to the fuel canister top, and retaining the plurality of detents spaced radially about the extinguisher. The retainer may be spring loaded to the torch top.

In some embodiments the torch comprises a skirt affixed to the retainer. The skirt may have a circumference greater than the fuel canister top. The extinguisher may comprise a tube that slides on an outside of the wick holder and, when in the extended position, extends beyond the wick holder a distance at least twice an internal width of the wick holder. The recess may comprise a circumferential groove on the extinguisher. The circumferential recess may define between a circumferential ridge on the extinguisher and a spaced circumferential flange on the sliding tube.

The invention of the present disclosure, in another aspect thereof, comprises a self-extinguishing torch top including a stationary housing suspended from a fuel canister top, a wick tube affixed to the stationary housing and providing passage for a wick from the fuel canister top through the stationary housing, and an extinguisher that is slidable within the stationary housing and around the wick tube, the extinguisher having a retracted position that exposes the wick tube sufficiently to allow combustion of fuel from a wick therein and having an extended position where the extinguisher extends beyond the wick tube sufficiently to extinguish combustion of fuel from a wick in the wick tube. A biasing member inside the stationary housing urges the extinguisher toward the extended position, and an arrest mechanism retains the extinguisher in the retracted position and releases the extinguisher upon impact.

The arrest mechanism may comprise a retainer having a plurality of radially spaced apart detents in contact with the extinguisher when the extinguisher is in the retracted position. The arrest mechanism may comprise three detents spaced equidistantly apart. The arrest mechanism comprises a recess defined between a flange extending from an upper end of the extinguisher and a spaced apart ridge.

The retainer may be suspended by springs over the fuel canister top. The springs may be captive springs having a rigid fastener passing therethrough that partially compresses the springs. In some embodiments, the stationary housing occupies a portion of a fuel canister when the fuel canister top is attached to the fuel canister.

The invention of the present disclosure, in another aspect thereof, comprises a self-extinguishing torch top having a fuel canister top having a threaded attachment for selective fixation to a fuel canister, a stationary housing suspended within the threaded attachment to be at least partially within the fuel canister when the canister top is attached to the fuel canister, and a wick tube passing through the stationary housing providing passage for a wick from a position superior to the fuel canister top to a position inferior to the stationary housing inside the fuel canister. The device includes a spring biased extinguisher tube that is retained at least partially within the stationary housing by an arrest mechanism until release and, upon release, extends from the stationary housing upwardly surrounding and extending beyond the wick tube such that any combustion occurring on the wick in the tube is extinguished. The arrest mechanism comprises a retainer that is spring mounted above the fuel canister top and retains a plurality of spring loaded detents directed toward the extinguisher tube so as to contact a circumferential catch on the extinguisher tube when the extinguisher tube is not released.

In some embodiments, the catch is defined by a ridge protruding circumferentially outward from the extinguisher tube. The device may further comprise a skirt affixed to a top of the retainer and extending first laterally away from the extinguishing tube and then downward to cover the retainer, the skirt having an outer circumferential edge that is wider than the fuel canister top.

DETAILED DESCRIPTION OF THE PREFERRED EMBODIMENTS

Figure 1:
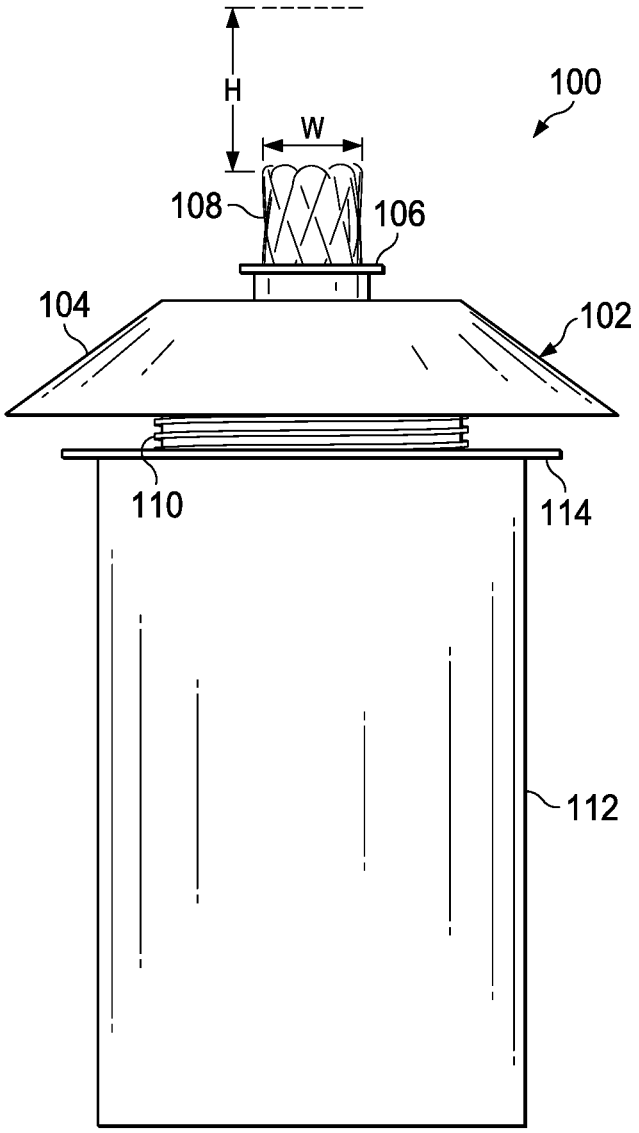
FIG. 1 is a side elevational view of a fuel canister with self-extinguishing torch top according to aspects of the present disclosure.

Referring now to FIG. 1, a side elevational view of a fuel canister with self-extinguishing torch top according to aspects of the present disclosure is shown. The illustrated assembly comprises a portion of a torch 100. Mounts, poles, containers, fixtures or other apparatus may form part of the torch 100 in some embodiments but are not shown for clarity. A self-extinguishing torch top 102 is affixed to a fuel canister 112. During use the fuel canister 112 may be placed into a previously mentioned stand or other fixture. A flange 114 may be provided as part of the torch top 102 or fuel canister 112 to allow the fuel canister 112 to nest in a container.

The self-extinguishing torch top 102 comprises a variety of internal components, which are described below. Externally the self-extinguishing torch top 102 includes a flame guard or skirt 104. A wick 108 is retained by the self-extinguishing torch top 102 and, as explained in further detail below, may be extinguished by extension of an extinguisher 106. The viewpoint of FIG. 1 shows the extinguisher 106 in an arrested or retracted position such that a sufficient portion of the wick 108 is exposed to allow combustion of fuel thereon. Contained within the self-extinguishing torch top 102 is an arrest mechanism that prevents the extinguisher 106 from extending until the fuel canister 112 and/or the skirt 104 receives an impact or other jarring force. Such an impact might be indicative of an upset or overturn event whereupon it would be advantageous to have any flame on the wick 108 extinguished automatically. The extinguisher 106 is spring-biased to extend beyond the wick 108 to extinguish any flame thereon upon the impact of jarring event. Notwithstanding the fact that the extinguisher 106 may be open topped, if the extinguisher 106 is made to extend beyond the wick 108 by a distance 'H' that is at least twice the width 'W' of the wick 108 combustion will cease. Such operation presumes the use of a typical decorative torch fuel, for example, paraffin or citronella. Various embodiments of the present disclosure also work with Tiki® brand Clean Burn™ torch fuel.

In some embodiments, the self-extinguishing torch top 102 is fitted to the fuel canister 112 by a threaded fitting 110. Other selectively detachable fittings may be utilized. In other embodiments the fuel canister 112 may be prefilled or is refillable by another mechanism allowing the self-extinguishing torch top 102 to be permanently affixed to the fuel canister 112.

Figure 2:
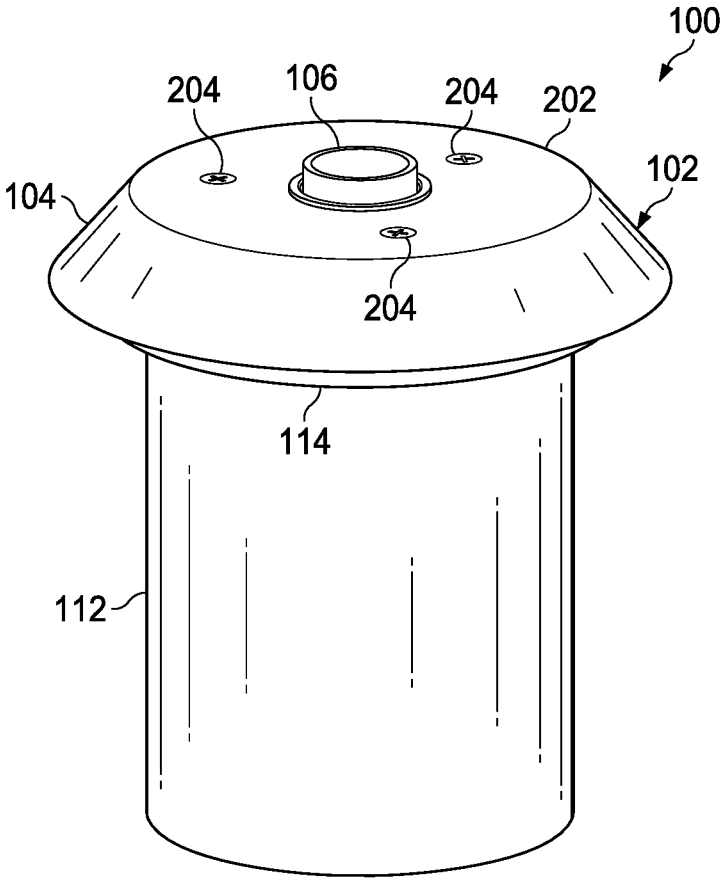
FIG. 2 is a side perspective view of the fuel canister with self-extinguishing torch top of FIG. 1.

Referring now to FIG. 2, a side perspective view of the fuel canister with self-extinguishing torch top 102 of FIG. 1 is shown. Again, only select components of the torch 100 are shown (i.e., the self-extinguishing torch top 102 affixed to the fuel canister 112). Other structures and/or decorative items are omitted for clarity. Also omitted from the remaining views is the wick 108. From the viewpoint of FIG. 2, it can be seen that the skirt 104 also includes a flat or planar upper surface 202. A number of fasteners 204 can be seen penetrating the upper surface 202 in order to secure part of the arrest mechanism as described below. Here again, the extinguisher 106 is shown in a retracted or arrested position. With reference also back to FIG. 1, it can be seen that the skirt 104 extends laterally beyond the fuel canister 112 and any associated flange 114. The skirt 104 is also intended to extend beyond any decorative holder, stand, or other item normally utilized with the torch 100. This helps to insure that if the torch 100 is overturned, upset, or encounters an impact, such impact is likely to be at least partially absorbed by the self-extinguishing torch top 102 to ensure extension of the extinguisher 106 as described more fully below.

Figure 3:
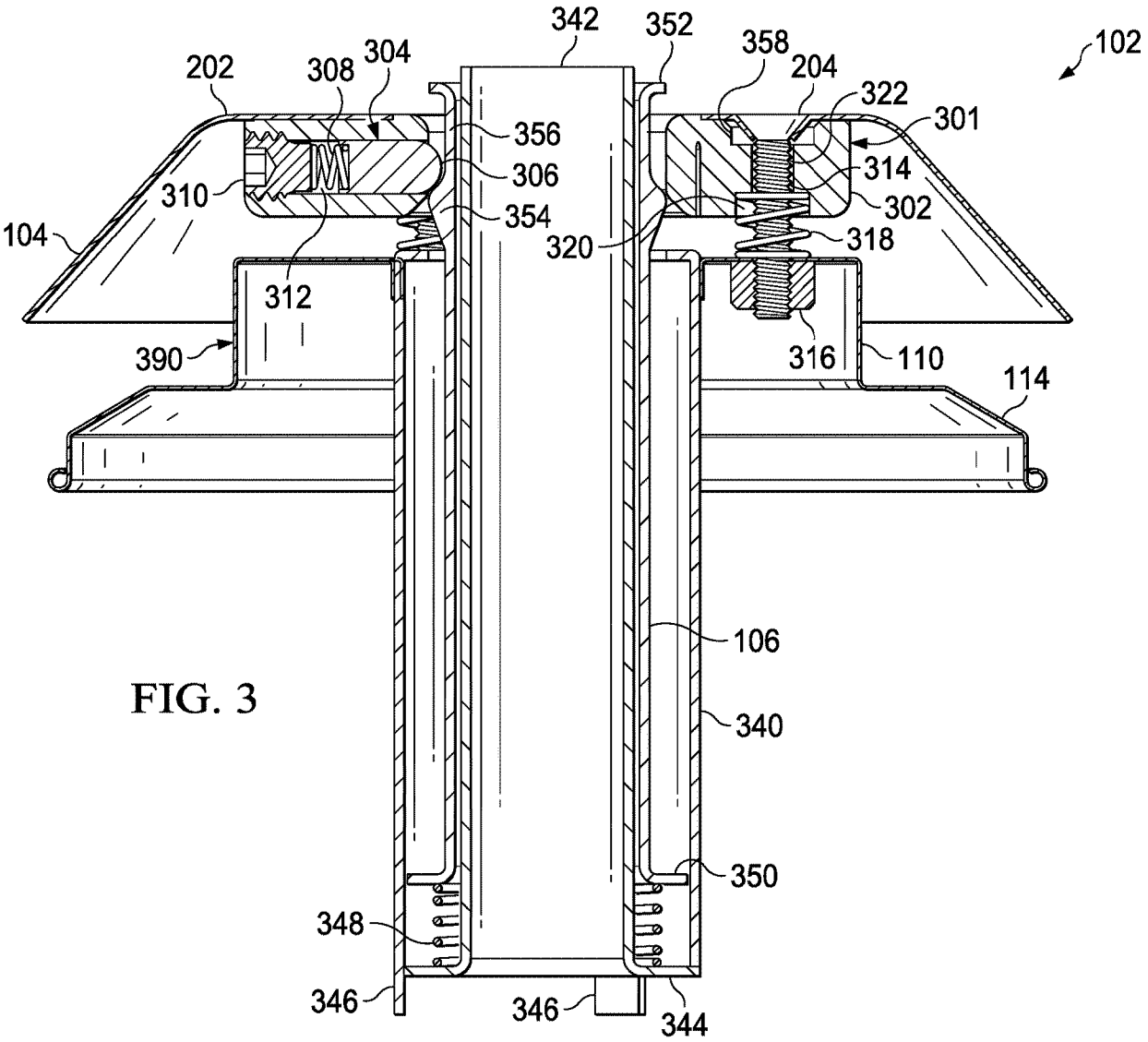
FIG. 3 is a side cutaway view of another embodiment of a self-extinguishing torch top according to aspects of the present disclosure.

Referring now to FIG. 3, a side cutaway view of another embodiment of a self-extinguishing torch top 102 according to aspects of the present disclosure it shown. The aforementioned arrest mechanism is shown generally as 301 in the present viewpoint and may be said to comprise a number of components. One such component is a retainer 302. The retainer 302 retains and properly orients a number of detents 304. In the present embodiment, the detents 304 comprise a pin 306 loaded by a spring 308 backed by a plug 310. These components are all encapsulated into one of a plurality of spaces 312 defined by the retainer 302. Although in the present embodiment pin detents are used, ball detents, or other detent mechanisms could also be utilized. The retainer 302 may be made from a molded or machined block of alloy or polymer with necessary spaces 312. In another embodiment, the retainer 302 is formed from sheet metal. In the present embodiment, the plugs 310 are threaded to allow the space 312 to be closed upon completion of construction of the detent 304. In other embodiments, the plug 310 could be welded or glued in place, or replaced with a fixed stop.

The retainer 302 may be anchored to the skirt 104 via one or more of the fasteners 204. In the present embodiment, the fasteners 204 comprise a bolt 314 and a nut 316. The bolt 314 may serve to anchor the skirt 104 securely to the retainer 302 by being inserted into an opening 322 defined through the retainer 302. In some embodiments, the opening 322 is threaded to cooperate with the bolt 314. A recess 358 may be machined into the retainer 302 in order to allow the bolt 314 to be countersunk.

The self-extinguishing torch top 102 also comprises a fuel canister top 390 that may be considered a separate component. The fuel canister top 390 affixes to the fuel canister 112, (e.g., via the fitting 110) and may also include the flange 114. The fuel canister top 390 is movably affixed to the retainer 302 by the bolt 314 and nut 316 (actually a plurality of nuts and bolts may be utilized, out of frame in FIG. 3). The nut 316 is not captive to the fuel canister top 390 and, accordingly, a degree of movement is allowed between the retainer 302 and the fuel canister top 390. Surrounding the bolt 314, spanning between the retainer 302 and the fuel canister top 390, is a spring 318. The spring 318 provides a degree of stability for the retainer 302 and the skirt 104 relative to the fuel canister top 390 but will allow a degree of movement upon impact.

Although only a single detent 304 and a single fastener 204 can be seen in the viewpoint of FIG. 3, the present embodiment provides three of each of these (three fasteners 204 can be seen from the viewpoint of FIG. 2, for example). However, in other embodiments more or fewer detents and/or fasteners 204 may be utilized. The present embodiment utilizes three of each on the basis that three provide reliable and repeatable performance without excessive component counts.

The fuel canister top 390 is rigidly affixed to a suspended housing 340 that extends generally downward through the fitting 110 and into a portion of the interior of any attached fuel canister. The housing 340 is also rigidly affixed to a wick holder 342. A flange 344 of the wick holder 342 anchors the wick holder 342 concentrically within the housing 340. The wick holder 342 extends upwardly through, or at least to, the retainer 322 and/or the skirt 104. The flange 344 of the wick holder 342 may be grasped or anchored by one or more tabs 346 proceeding from the housing 340.

The illustration of FIG. 3 shows the extinguisher 106 in a retracted or arrested position. In this state or condition the plurality of detents 304 retain the extinguisher 106 in its illustrated arrested or retracted position. Absent the presence of the detents 304, the extinguisher 106 would be generally free to slide upward around the wick holder 342. The extinguisher 106 may be biased towards an extended or upward position by a biasing member 348. In the present embodiment, the biasing member 348 comprises a coil spring. In other embodiments, other biasing mechanisms could be used such as leaf springs or pneumatic mechanisms. The extinguisher 106 includes a lower flange 350 that insures substantial contact against the biasing member 348. An upper flange 352 may be provided on the opposite upper end of the extinguisher 106. A recess 356 is defined between a circumferential ridge 354 that is spaced apart downwardly from the upper flange 352. The ridge 354, along with the detents 304 held by the retainer 302, may be considered part of the arrest mechanism 301. The pin 306 of the detent 304 rests against the ridge 354 and/or the recess 356 to hold the extinguisher 106 in place when in the retracted position.

In the embodiment of FIG. 3, the ridge 354 and the upper flange 352 define the recess 356. However, the recess 356 could be formed by inletting or defining a groove in a sidewall of the extinguisher 106, where the thickness of the sidewall allows. In other embodiments, the upper flange 352 may be absent such that the recess 356 simply comprises the portion of the sidewall of the upper flange 352 immediately above the ridge 354. The presence of the ridge 354 may provide sufficient purchase for the detents 304 and act as a catch to allow static retention of the extinguisher in the arrested position. The size and length of the extinguisher 106 may be sufficient to prevent over insertion when being placed into the arrested position.

The wick holder 342 may be tubular and may have a circular profile when viewed from above. The diameter of the wick holder 342 may vary depending upon the size of wick 108 (FIG. 1) but may generally range from about 0.25 inches to about 0.75 inches in diameter. As discussed above, the wick diameter has some bearing on the amount of extension required to be achievable by the extinguisher 106 in order to adequately snuff or extinguish the flame on the wick 108 when deployed or extended. The wick holder 342 may retain the wick 108 in a friction fit. The wick 108 may be a woven fiberglass or polycotton wick that is intended to be more or less permanent (e.g., it is not consumed through typical use).

Although in the present embodiment, the wick 108 and wick holder 342 are tubular with a circular lateral cross section, other cross sections or shapes may be employed. However, utilizing a tubular (circular lateral cross section) for the wick 108, wick holder 342, and extinguisher 106 allows a nesting arrangement between these components that promotes reliability and ease of manufacture. The housing 340 may also be tubular (with a circular lateral cross section) such that the wick holder 342 may be concentrically rigidly retained therein. The biasing member 348 may then coil about the wick holder 342 and interface with the extinguisher 106 (which may be concentrically arranged about the wick holder 342) via the flange 350, which may take on a disc shape.

The extinguisher 106 may not necessarily have the same general shape as the wick holder 342 in all embodiments, but such a configuration may provide for increased reliability and ease of manufacture. The extinguisher 106, if provided with a tubular radial symmetry, may be guided between the wick holder 342 and the detents 304 and its performance will not depend on angular orientation. The flange 350, ridge 354, recess 356, and/or upper flange 352 may then be constructed with the same circular or radial symmetry. The upper flange 352 may further serve to promote reliability by providing at least some ability to ride over or deflect soot or other debris that may be present around the upper end of the wick holder 342 when the extinguisher 106 is extended. The upper flange may also be useful to improve the ease with which the extinguisher 106 can be reset.

The housing 340, wick holder 342, and the extinguisher 106 may be made from suitably heat resistant metals or alloys. They may be cast, machined, or molded to the appropriate shape and configuration and they are not necessarily made from the same material. Depending upon methods and materials of manufacture clearance between the wick holder 342 and extinguisher 106 may be from a few hundredths of an inch or less, so long as the extinguisher is not prevented from extending under the force of the biasing member 348 after impact.

In operation when the torch top 102 becomes upset, overturned, and/or experiences an impact, the movement allowed between the retainer 302 and the fuel canister top 390 will allow one or more of the detents 304 to lose contact with the ridge 354 and/or recess 356. The remaining detents will not be sufficiently strong, or will be unable to extend sufficiently inward, to prevent the biasing member 348 from pushing the extinguisher 106 upward through the retainer 302. (In some embodiments, the detent pins 306 are captive and cannot pass completely out of the retainer 301 due to the retainer 301 not providing a large enough inwardly facing opening to allow the detent pins to escape completely.) Even in the event that contact is not lost between any detent 304 and the extinguisher 106, the impact and movement resulted therefrom is enough that the detents can no longer provide enough inward force against the ridge 354 so as to keep the extinguisher 106 in the lower or arrested position.

Figure 4:
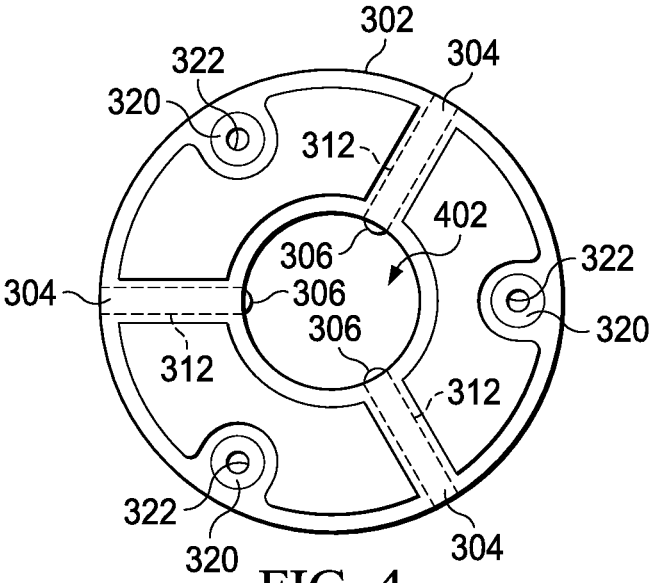
FIG. 4 is an inferior plan view of a detent retainer for use with self-extinguishing torch tops according to aspects of the present disclosure.

Referring now to FIG. 4, an inferior plan view of the retainer 302 is shown. The illustration of FIG. 4 depicts a lower side of the retainer 302 that is opposite the skirt 104, and facing toward the fuel canister top 390. Here the radial arrangement of the detents 304 can be seen and the pins 306 protruding inwardly into an opening 402 defined by the retainer 302 can be seen. The general location of the openings machined into the retainer 302 can be seen in phantom. In the present embodiment, three detents 304 are shown spaced apart approximately 120° from one another. In other embodiments more or fewer detents may be provided and/or they may be spaced differently than shown. The threaded openings 322 can be seen surrounded by recesses 320. In the present embodiment, the retainer 302 has been designed with removal of excess material but in other embodiments the retainer 302 may be completely solid or filled in except for the specifically described openings and passages.

Figure 5:
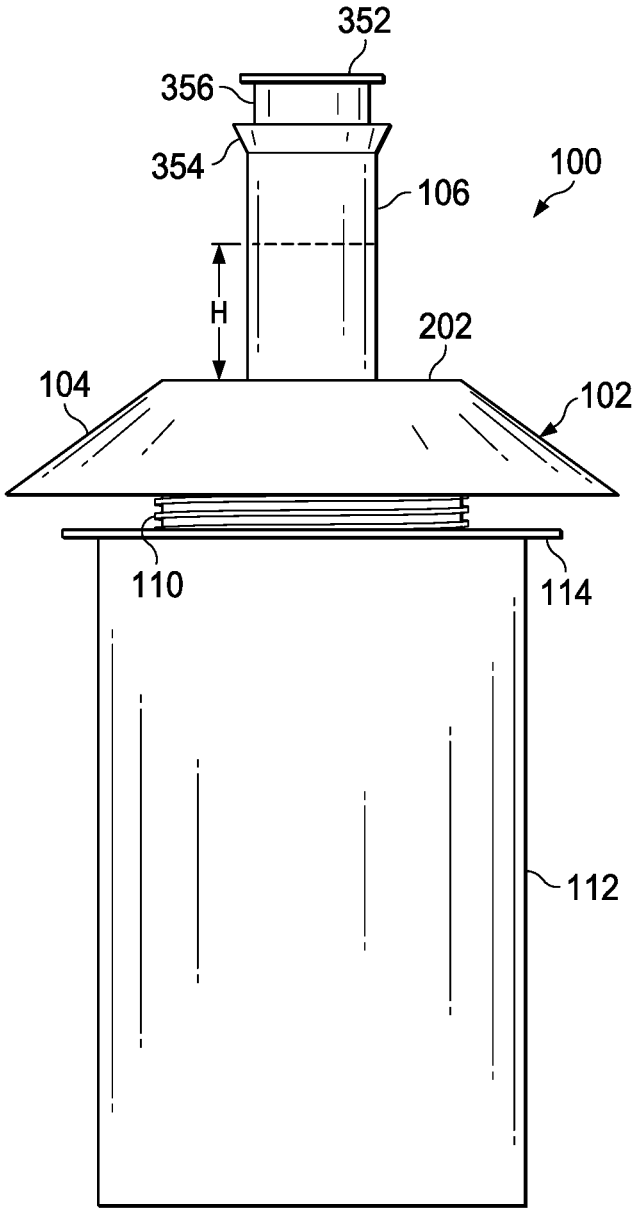
FIG. 5 is a side elevational view of a fuel canister with self-extinguishing torch top having an extended extinguisher according to aspects of the present disclosure.

Referring now to FIG. 5, a side elevational view of a fuel canister with self-extinguishing torch top having an extended extinguisher is shown. The configuration of FIG. 5 is encountered following an overturn or impact to the torch 100. Here it can be seen that the extinguisher 106 has been released from the arrested position and has been driven upward by the biasing member 348 into an extended position as shown. The extended position of the extinguisher 106 shown in FIG. 5 is at least as tall as the height 'H' (FIG. 1) above the top of the wick 108. The height 'H' is twice or more than the width 'W' of the wick 108 as previously described. With the torch 100 turned to an upright position and allowed a sufficient time to cool, a user may press the extinguisher 106 down until the ridge 354 passes the detents 304 and the extinguisher 106 will be retained once more in the arrested position unless and until a further impact occurs. If the skirt 104 is sufficiently cool (or if the user uses a mitt, tongs, or other insulative implement) the skirt 104 may be touched, pressed, rocked, or bumped to release the extinguisher 106 to the extended position to act as a user selective snuffer.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A self-extinguishing torch top comprising:

a wick holder having an upper end and a lower end, and affixed to a fuel canister top;

an extinguisher surrounding the wick holder and having at least a retracted position wherein a wick protruding from the wick holder is sufficiently exposed to be allowed to bum and at least an extended position wherein the extinguisher extends beyond the wick so far as to extinguish any flame on the wick;

a biasing member that urges the extinguisher toward the extended position; and an arrest mechanism that retains the extinguisher in the retracted position until an impact occurs, upon which the arrest mechanism releases the sliding tube to allow its extension to the extended position;

wherein the arrest mechanism comprises at least one spring loaded detent extending inward toward the extinguisher and at least one recess defined in the extinguisher for receiving the detent when the extinguisher is in the retracted position; and wherein the arrest mechanism comprises are retainer attached to the fuel canister top and retaining a plurality of detents spaced radially about the extinguisher.

2. The self-extinguishing torch top of claim 1, wherein the retainer is spring loaded to the torch top.

3. The self-extinguishing torch top of claim 2, further comprising a skirt affixed to the retainer.

4. The self-extinguishing torch top of claim 3, wherein the skirt has a circumference greater than the fuel canister top.

5. The self-extinguishing torch top of claim 1, wherein the extinguisher comprises a tube that slides on an outside of the wick holder and, when in the extended position, extends beyond the wick holder a distance at least twice an internal width of the wick holder.

6. The self-extinguishing torch top of claim 5, wherein the recess comprises a circumferential groove on the extinguisher.

7. The self-extinguishing torch top of claim 5, wherein the recess is defined between a circumferential ridge on the extinguisher and a spaced circumferential flange on the sliding tube.

8. A self-extinguishing torch top comprising:

a stationary housing suspended from a fuel canister top;

a wick tube affixed to the stationary housing and providing passage for a wick from the fuel canister top through the stationary housing;

an extinguisher that is slidable within the stationary housing and around the wick tube, the extinguisher having a retracted position that exposes the wick tube sufficiently to allow combustion of fuel from a wick therein and having an extended position where the extinguisher extends beyond the wick tube sufficiently to extinguish combustion of fuel from a wick in the wick tube;

a biasing member inside the stationary housing that urges the extinguisher toward the extended position; and an arrest mechanism that retains the extinguisher in the retracted position and releases the extinguisher upon impact;

wherein the arrest mechanism comprises a retainer having a plurality of radially spaced apart spring loaded detents in contact with the extinguisher when the extinguisher is in the retracted position; and wherein the retainer is suspended by springs over the fuel canister top.

9. The self-extinguishing torch top of claim 8, wherein the arrest mechanism comprises three detents spaced equidistantly apart.

10. The self-extinguishing torch top of claim 8, wherein the arrest mechanism comprises a recess defined between a flange extending from an upper end of the extinguisher and a spaced apart ridge.

11. The self-extinguishing torch top of claim 8, wherein the springs are captive springs having a rigid fastener passing therethrough that partially compresses the springs.

12. The self-extinguishing torch top of claim 8, wherein the stationary housing occupies a portion of a fuel canister when the fuel canister top is attached to the fuel canister.

13. A self-extinguishing torch top comprising:

a fuel canister top having a threaded attachment for selective fixation to a fuel canister;

a stationary housing suspended within the threaded attachment to be at least partially within the fuel canister when the canister top is attached to the fuel canister;

a wick tube passing through the stationary housing providing passage for a wick from a position superior to the fuel canister top to a position inferior to the stationary housing inside the fuel canister;

a spring biased extinguisher tube that is retained at least partially within the stationary housing by an arrest mechanism until release and, upon release, extends from the stationary housing upwardly surrounding and extending beyond the wick tube such that any combustion occurring on the wick in the tube is extinguished;

wherein the arrest mechanism comprises a retainer that is spring mounted above the fuel canister top and retains a plurality of spring loaded detents directed toward the extinguisher tube so as to contact a circumferential catch on the extinguisher tube when the extinguisher tube is not released;

wherein the catch is defined by a ridge protruding circumferentially outward from the extinguisher tube.

14. The self-extinguishing torch top of claim 13, further comprising a skirt affixed to a top of the retainer and extending first laterally away from the extinguishing tube and then downward to cover the retainer, the skirt having an outer circumferential edge that is wider that the fuel canister top.

* * * * *